US009180602B2

(12) United States Patent
Stahl

(10) Patent No.: US 9,180,602 B2
(45) Date of Patent: Nov. 10, 2015

(54) METHOD OF AND APPARATUS FOR MAKING MESH-LIKE METAL MATS

(75) Inventor: Karl-Hermann Stahl, Voehringen (DE)

(73) Assignee: HACANOKA GMBH, Voehringen (DE)

( * ) Notice: Subject to any disclaimer, the term of this patent is extended or adjusted under 35 U.S.C. 154(b) by 165 days.

(21) Appl. No.: 13/810,693

(22) PCT Filed: Jul. 20, 2011

(86) PCT No.: PCT/DE2011/001503

§ 371 (c)(1),
(2), (4) Date: Feb. 1, 2013

(87) PCT Pub. No.: WO2012/031577

PCT Pub. Date: Mar. 15, 2012

(65) Prior Publication Data

US 2013/0216851 A1 Aug. 22, 2013

(30) Foreign Application Priority Data

Sep. 8, 2010 (DE) ..... 10 2010 044 695

(51) Int. Cl.
*B26D 3/08* (2006.01)
*B21D 31/04* (2006.01)
(Continued)

(52) U.S. Cl.
CPC ..... *B26D 3/085* (2013.01); *B21D 31/043* (2013.01); *B21H 8/005* (2013.01); *B26F 3/002* (2013.01); *B26F 3/02* (2013.01); *Y10T 29/18* (2015.01);
(Continued)

(58) Field of Classification Search
CPC ..... Y10T 29/18; Y10T 29/185; Y10T 29/301; B21C 37/02; B21D 25/00; B21D 31/04; B21D 31/043
See application file for complete search history.

(56) References Cited

U.S. PATENT DOCUMENTS 4,305,187 A 12/1981 Iwamura
2006/0121241 A1* 6/2006 Bonds ..... 428/122
(Continued)

FOREIGN PATENT DOCUMENTS

GB 537553 B 6/1941
JP 10034253 B 2/1998

*Primary Examiner* — Christopher Besler
(74) *Attorney, Agent, or Firm* — Andrew Wilford

(57) ABSTRACT

The method serves for producing network-like metal mats from metallic strip material, for which purpose the strip material is first provided with notches (2), running parallel to one another, for the forming of metal wires (1), by means of notching rollers. The notches (2) are thereby formed to such depths, depending on the material, that as far as possible no sliding fractures are formed. The notches (2) are interrupted by unnotched regions—the mutual spacing of which in the respective notch (2) determines the later possible mesh width—at least in such a way that they later form network nodes (4). The network nodes (4) are offset by approximately half a network node spacing in the respectively adjacent notches (2). Then, the strip, formed in this manner, is subjected to a flexing process, in which the webs (3) adjoining the base of the notch and still connecting the metal wires (1) to one another undergo multiple bending deformation about the longitudinal axis thereof in such a way that incipient cracks occur as a result of fatigue fracture. This leads to the complete separation of the metal wires (1) in the region of the webs (3), while no incipient cracks form at the network nodes (4). Finally, the strip material is subjected to transverse tensile forces acting on both its peripheral metal wires (1), whereby a widening deformation of the wire strip (5) into a network-like structure takes place.

9 Claims, 4 Drawing Sheets

(51) Int. Cl.

| | |
|---|---|
| ***B21H 8/00*** | (2006.01) |
| ***B26F 3/00*** | (2006.01) |
| ***B26F 3/02*** | (2006.01) |

(52) U.S. Cl.

CPC ..... *Y10T 29/185* (2015.01); *Y10T 83/0341* (2015.04); *Y10T 83/0385* (2015.04); *Y10T 83/0424* (2015.04); *Y10T 83/323* (2015.04); *Y10T 225/12* (2015.04); *Y10T 428/12361* (2015.01)

(56) References Cited

U.S. PATENT DOCUMENTS

| | | | | |
|---|---|---|---|---|
| 2007/0050960 | A1 * | 3/2007 | Stuhlbacher et al. | 29/6.2 |
| 2010/0129678 | A1 | 5/2010 | Stahl | |
| 2011/0212343 | A1 | 9/2011 | Stahl | |
| 2012/0231291 | A1 | 9/2012 | Stahl | |

* cited by examiner

METHOD OF AND APPARATUS FOR MAKING MESH-LIKE METAL MATS

CROSS REFERENCE TO RELATED APPLICATIONS

This application is the US-national stage of PCT application PCT/DE2011/001503 filed 20 Jul. 2011 and claiming the priority of German patent application 102010044695.5 itself filed 8 Sep. 2010.

The invention relates to a method of making mesh-like metal mats from metal strip material. In addition, the invention relates to an apparatus for carrying out the method and to a mesh-like metal mat that is made according to the method.

Various different methods are known in the art for producing metal mats of this type; for example, metal meshes are often woven out of wire in very diverse forms. This generally applies to relative thin wires, such as for example those used for sieves. However, fences too are made in analogous fashion from wire netting. If, however, the wire cross sections are too large that they cannot be woven for example bars are placed at right angles one on the other and welded together. This is the approach by which for example reinforcement mats are made for the construction industry.

Due to the laborious procedural manipulation involved, however, using individual wires or bars is cost-intensive, and therefore the object of the invention is to provide a method by which metal meshes can be created without having to employ previously prefabricated wires or bars for this purpose.

This object is achieved according to the invention whereby strip material is provided with parallel grooves by notch-rolling so as to create metal wires, wherein the grooves are made sufficiently deep, depending on the material, that to the greatest extent possible no shear fractures are created, and wherein the grooves are interrupted in at least one way by unnotched regions—whose spacing in the given notch determines the subsequent possible mesh width—such that these subsequently form mesh crossings that are spaced in the respective adjacent grooves by approximately half the mesh node spacing such that the thus-formed strip is then made to undergo a flexing process in which the webs adjoining the notch base and still connecting the metal wires to each other undergo repeated bending deformation about their longitudinal axis such that incipient cracks are formed due to fatigue fracture which result in a complete separation of the metal wires at the webs while no incipient cracks are formed at the mesh crossings, and wire strip thus made is exposed to transverse tensile forces acting on its two peripheral metal wires such that a transverse stretching deformation of the wire strip is effected so as to create a mesh-like structure.

The advantage achieved by the invention consists first of all essentially in the fact that the production of these metal mats does not have to start with already prefabricated, and also cost-intensive, wires and bars, but instead strip material is employed here as the starting product. A further advantage consists in the fact that the metal wires creating the subsequent metal mat are not assembled to form the mesh-like structure and do not possibly necessitate being joined to each other; instead these form a one-piece unit already during the production process such that flexing at the grooves, by which action the metal wires are released from each other, enables the mesh-like metal mat to be created by a simple transverse stretching process. With regard to the creation of metal wires, additional reference is made to WO 2008/135002 [US 2010/0129678], also DE 10 2008 034 250 [US 2011/0212343], and DE 10 2009 048 751. As these have already described, the strip material that is used as the starting material can be quite varied in terms of strength, in other words, can have, in particular, significantly higher strength and also lower strength than conventional construction steel.

The mesh size of the mesh structure can be adjusted here within certain limits based on requirements, as a result of which the individual mesh can vary between a rhombus and a rectangle. If the main loading direction of the metal mat is located in its longitudinal axis, the selected mesh widths can be smaller while taking into account the concrete mixture.

The embodiment that is considered advantageous and thus preferred within the scope of the invention is one whereby the number of metal wires is an even number. This ensures symmetrical force conditions during the subsequent transverse stretching procedure.

It has been found furthermore advantageous if the length of the mesh crossings as measured longitudinally of the grooves is approximately two to four times the thickness of the strip material Another advantageous embodiment of the invention is provided whereby each notch is composed of a plurality of notch sections, with the unnotched regions located between the notch sections forming anchor lugs in the form of anchor projections after the metal wires have been separated. These anchor projections have an effect that is analogous to the corrugations on the bars of reinforcement mats that provide anchoring in the concrete. It is recommended in this regard that the unnotched regions located between the notch sections be scored to allow subsequent separation in the longitudinal axis of the grooves Although it is possible in principle to notch only one surface of the strip material, it is more advantageous for various reasons for the strip material to be provided in corresponding fashion with grooves or notch sections on both faces in order to create the mesh crossings and anchor lugs, the anchor lugs of the top side also being offset relative to the bottom face of the strip.

In order to achieve the optimum separation of the metal wires before the subsequent transverse stretching of the strip material, the invention proposes an approach whereby the number of bending motions and the bending angles during the flexing process is selected such that the webs and the anchor webs are separated from each other but the mesh crossings are not yet initially cracked.

It is advantageous in terms of the required scoring of the anchor webs before flexing for the mesh crossings to be provided with a trough-shaped indentation running longitudinally of the grooves. Depending on the properties of the metal strip material used, it can be advantageous for the notched strip material to pass through a separation rolling unit in which a complete separation of the metal wires is reliably provided, except at the mesh crossings, which aspect facilitates forming the strip material into a mesh-like metal mat.

In terms of an apparatus, the object of creating an apparatus for carrying out the described method is achieved by an approach wherein the apparatus is composed of an arrangement for notching metal strip material by preferably two notching rolls that notch the strip material between them, thereby creating metal wires of a length delimited by mesh crossings, is furthermore composed, as required, of an arrangement for scoring unnotched regions within the grooves that are distributed along the grooves and form anchor webs, is furthermore composed, as required, of a flex rolling arrangement that effects bending deformation of the metal wires opposite each other along their interconnecting web, is additionally composed, as required, of a separation rolling unit for completely and reliably separating the metal wires at the grooves, and finally is composed of a transverse stretching arrangement to draw or spread the strip material or the wire strip to form a mesh-like metal mat that can be cut to length or also rolled up.

It is especially advantageous here for the transverse stretching arrangement to be provided with dragged grippers that are disposed on both sides of the wire strip and roll along guide rails that open in a V-shape in the transport direction of the wire strip.

In order to enable the grippers to engage the wire strip, the invention provides an approach whereby a gripper-setting unit is provided at the upstream ends of the guide rails, which unit engages gripper with both edges of the wire strip between the peripheral metal wires and the wires adjacent thereto.

In order to achieve a uniform drawing of the wire strip, in particular to achieve a symmetrical structure, a positioning device is provided to press in the grippers approximately at the center of the mesh crossings of the bilateral outside grooves.

It has been found advantageous in terms of the changing strip feed rate in the transverse stretching zone if a drawing device composed of transport rollers for the mesh material is provided downstream of the guide rails.

The mesh material, which can be used for example as a reinforcement mat or mesh, can be wound up into a coil of relatively high weight, with the result that it can be stored or transported in a space-saving way, then unrolled, straightened, and cut to length at the place of use. In addition, the transverse stretching apparatus together with a coil reel and shearing means can be designed to be transportable, thereby allowing the reinforcement mat to be made ready for use, as desired, that is, spread and cut to length, once on the site, that is for example at the construction site. The width here of the reinforcement mat can be adjusted within certain limits by changing the opening angle of the guide rails of the drawing unit. It is similarly possible to produce reinforcement mats of considerable length.

Finally, the invention relates to another mesh-like metal mat, with or without anchor lugs, that is made by the above-described method and by the apparatus also described, which mat is composed according to the invention of metal wires, each of which is connected at the ends to a mesh node, wherein four metal wires each terminate at each mesh node, and wherein the metal wires and the mesh crossings are composed of the strip material from which the metal wires have been released from each other by notch rollers and subsequent separation, and are formed by lateral transverse stretching to create a mesh structure.

The following describes the invention in more detail with reference to an illustrated embodiment that is shown in the drawing. Therein:

Figure 2:
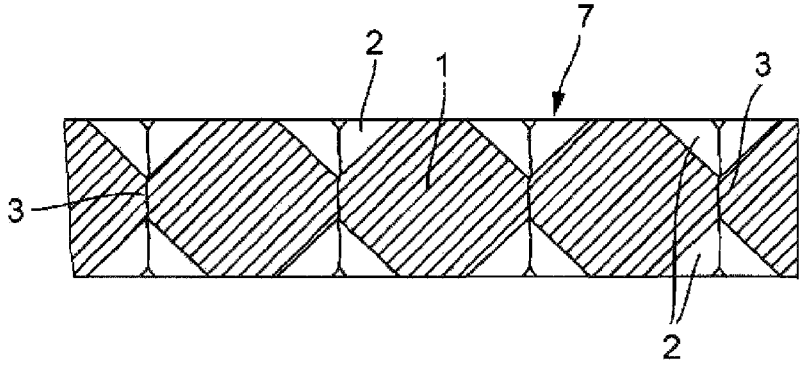
FIG. 2 is a cross section through the strip material after notch-rolling taken along line E-E of FIG. 1.
Figure 3:
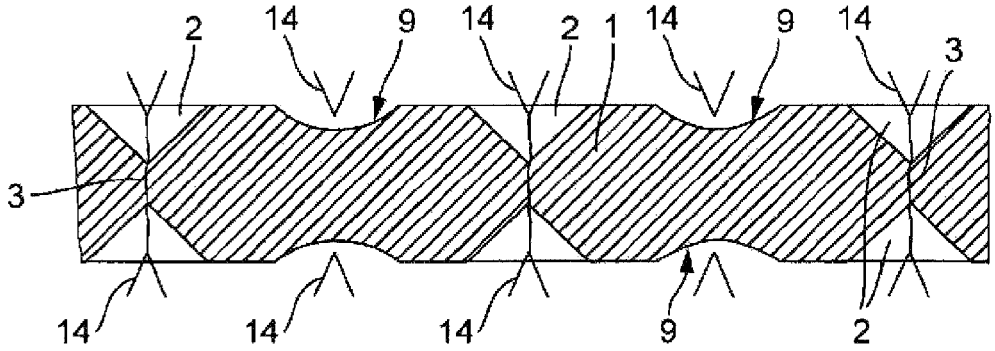
FIG. 3 is a cross section through the item in FIG. 1, but at the mesh crossings taken along line F-F of FIG. 1.
Figure 5:
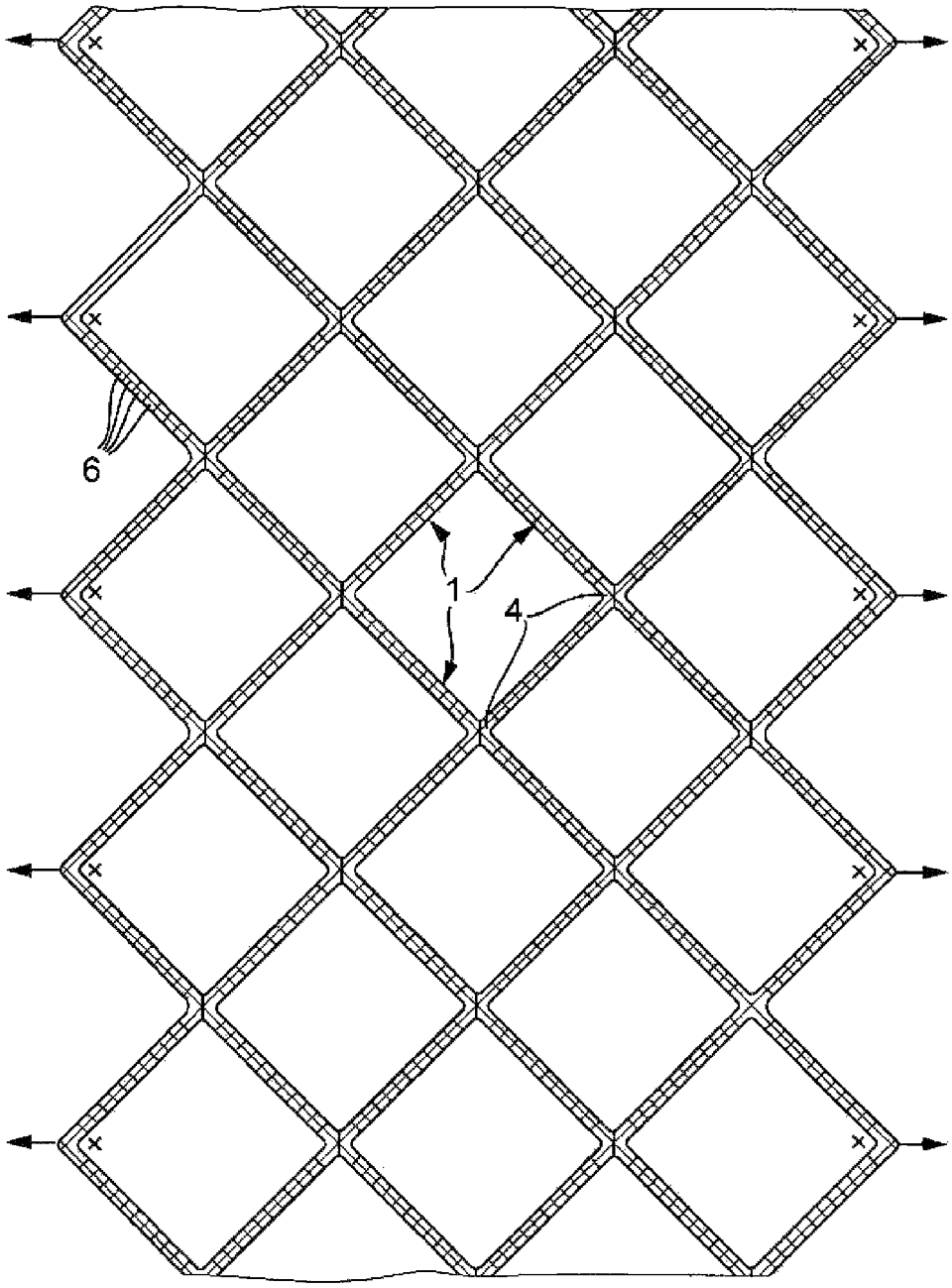
FIG. 5 shows a wire strip that has been transversely stretched to form a mesh-like metal mat.
Figure 6A:
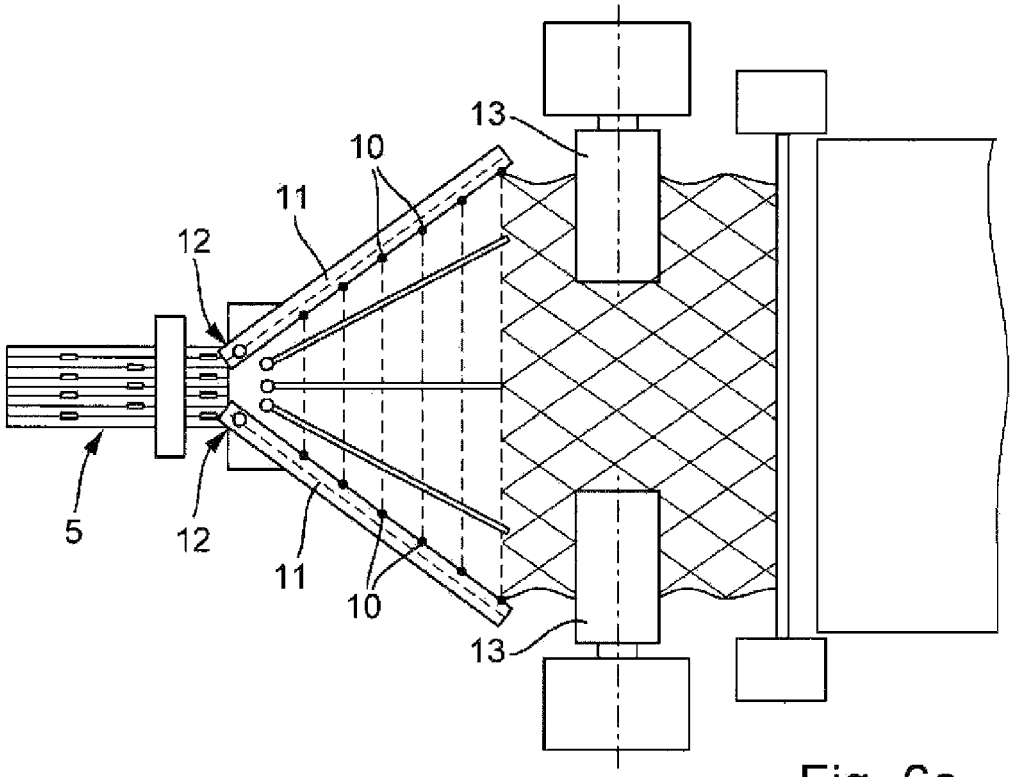
FIG. 6 is a top view and side view of the transverse stretching arrangement for drawing the wire strip.
Figure 6B:
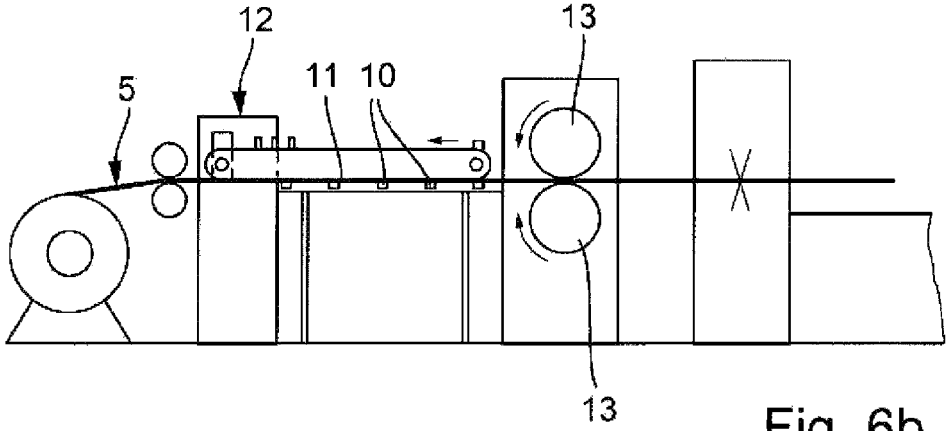

The apparatus, only part of which is shown in the drawing of FIG. 6, carries out the method that enables mesh-like metal mats as indicated in FIG. 5 to be made from metal strip material. The strip material here is first provided by notch rolling with parallel longitudinal grooves 2 that create metal wires 1 between them, which grooves are of a length that determines the subsequent mesh width. Downstream of this, metal wires 1 are still interconnected by remaining webs 3, as is shown in FIGS. 2 and 3. This notch-rolling is otherwise described in more detail in the previous patent application WO 2008/135002.

However, the notch-rolling here is done such that between the ends of two grooves 2 two regions are left that form the subsequent mesh crossings 4. In addition, the mesh crossings 4 in two adjacent grooves 2 are longitudinally offset relative to each other by approximately half the groove length, thus producing—after subsequent transverse stretching—the structure seen in FIG. 5.

The strip material is then made to undergo a flexing process in which each web 3 undergoes repeated bending deformation about its longitudinal axis such that incipient cracks are formed by fatigue fracture at webs 3, the cracks resulting in a separation of the metal wires 1 at the grooves 2. This flexing process is also described in the above-referenced patent application WO 2008/135002.

Figure 1:
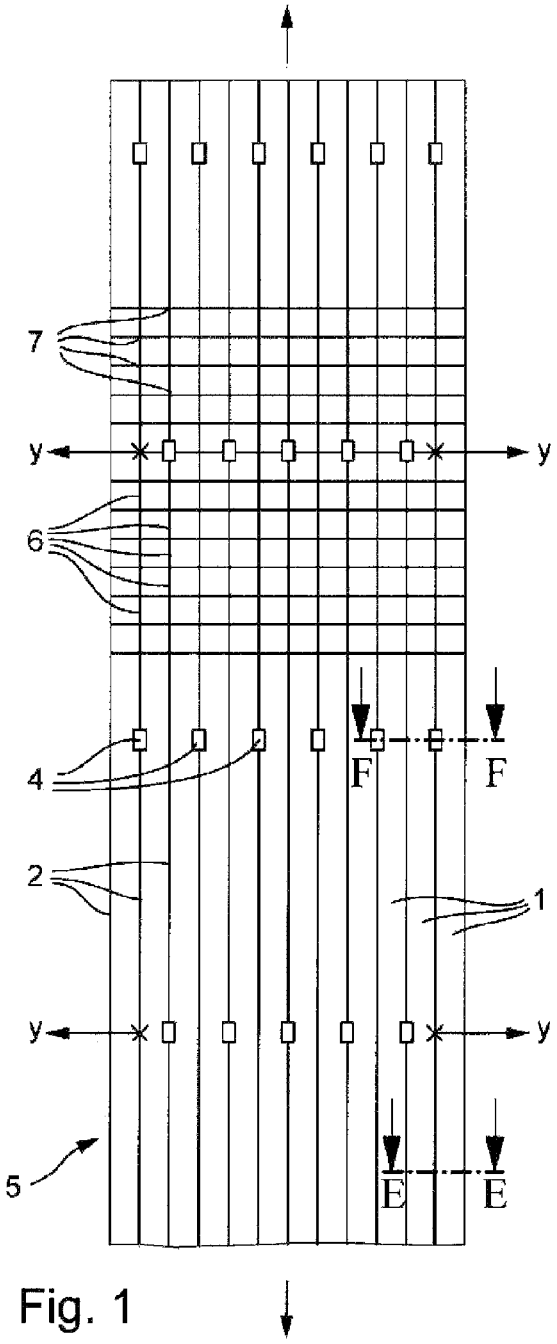
FIG. 1 is a top view of a notch-rolled wire strip including mesh crossings and anchor webs.

Finally, the wire strip 5 thus composed of the strip material is exposed to tensile forces parallel to a Y axis in FIG. 1 that are applied to metal wires 1 at its two peripheral edges, with the result that a transverse stretching deformation is effected of the wire strip 5 to form a mesh-like structure, as is shown in FIG. 6, thus resulting in a metal mat as in FIG. 5.

In terms of a symmetrical configuration, the notching roll is designed such that the number of metal wires 1 made thereby is an even number.

Figure 7:
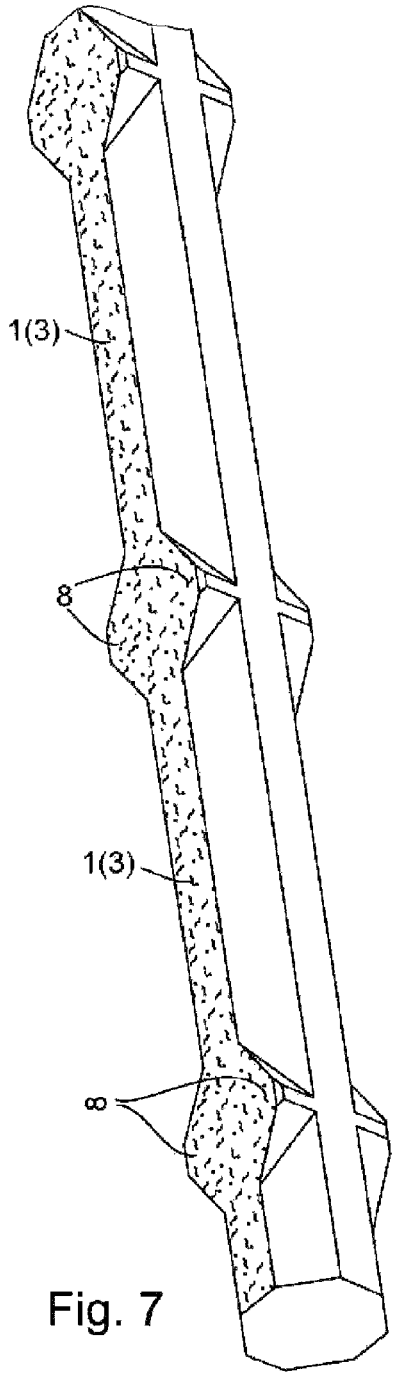
FIG. 7 is a detail illustrating an individual metal wire of a reinforcement mat including anchor lugs or nodes.

The length of the mesh crossings 4 as measured longitudinally of the grooves 2 is selected such that it corresponds to approximately two to four times the thickness of the strip material so as to have the strength required thereby In order to provide anchors on the metal wires 1, each notch 2 can be formed by a row of notch sections 6 with unnotched regions 7 located between notch sections 6 that form the anchor webs for the subsequent anchor projections in the form of anchor lugs 8. This is indicated in FIG. 1 by the transversely running lines that are only marked in one subsection, where the anchor projections are located at the intersection points and can be seen in detail in FIG. 7. Since the anchor webs have to be separated from each other to create the anchor lugs 8, they are scored at the anchor web center in the running direction of grooves 2 by a scoring tool 14, indicated only schematically in FIG. 3, before the flexing process.

Otherwise both faces of the strip material are provided with identical aligned grooves 2 and mesh crossings 4, as shown in FIGS. 2 and 3. However, the design of the anchor lugs 8 may correspond, but does not have to correspond.

The flexing process is carried out in the flexing arrangement, not illustrated in detail in the drawing, whereby the number of bends is performed and the bending angle are selected here such that webs 3 and the anchor webs are separated from each other without at the same time initially cracking the mesh crossings 4. Each mesh crossings 4 is provided with a trough-shaped indentation 9 running longitudinally of the grooves 2, as shown in FIG. 2, in order to prevent any scoring of the mesh crossings 4 together with the anchor webs.

Figure 4:
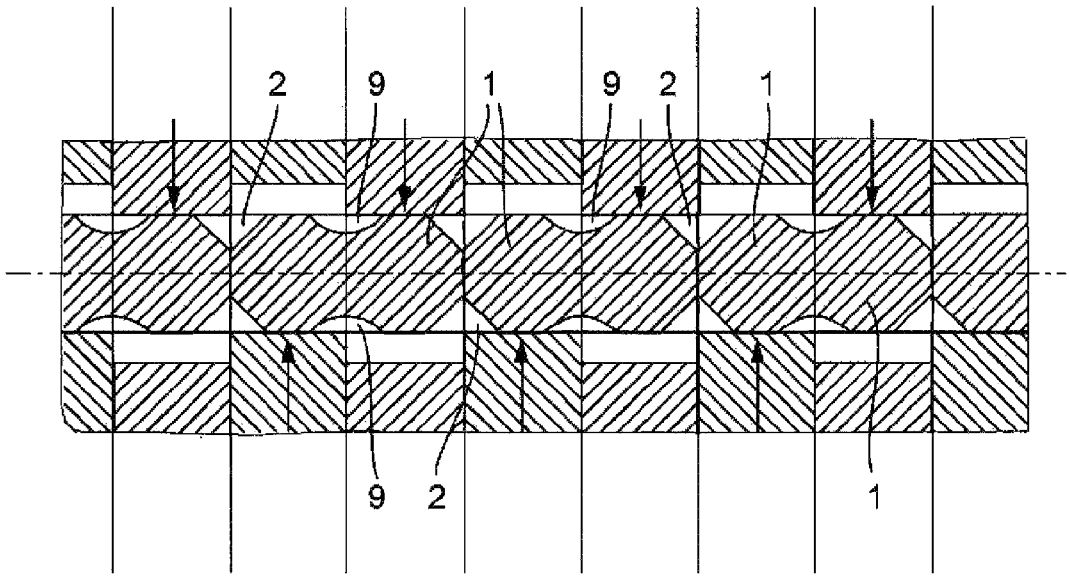
FIG. 4 shows a roll profile for testing the complete separation of the metal wires at the grooves and of the mesh crossings, based on FIG. 3.

Finally, the grooved wire strip 5 can then pass through another separation rolling unit in which the metal wires 1 are completely separated at the grooves and at the anchor webs, but not at the mesh crossings 4. This is shown in FIG. 4.

The transverse stretching arrangement illustrated in detail in FIG. 6, which functions to draw or spread the wire strip 5 or the metal wires 1 to create a mesh-like metal mat, is provided with grippers 10 that are moved on guide rails 11 provided on both sides of the wire strip 5 and open in a V-shape in the drawing direction.

A gripper-fitting unit 12 is provided at the upstream ends of the guide rails 11 that closes the grippers 10 at both edges of the wire strip 5 between the peripheral metal wires 1 and the metal wires more inward, and centrally between the mesh crossings 4. The gripping point is marked by x in FIG. 1. This gripper 10 then runs along the respective guide rail 11 and results here in transverse stretching of the wire strip 5, where the forces are transferred through the metal wires 1 and the mesh crossings 4 toward the center of the wire strip 5, thus also resulting in a transverse stretching action.

A positioning device is provided at the upstream ends of the guide rails 11 so as to achieve a uniform and symmetrical mesh structure, which device presses in the grippers 11 approximately at the center of the mesh crossings 4.

Since the wire strip is advantageously conveyed through the transverse stretching arrangement under tension, a drawing device for the wire strip 5 is provided downstream of the guide rails 12, which drawing device is formed by transport rollers 13.

The invention claimed is:

1. A method of making mesh-like metal mats from metal strip material, the method comprising:

notch-rolling the metal strip material to form therein parallel adjacent grooves between metal wires and to make the grooves sufficiently deep that substantially no shear fractures are created while leaving between the grooves unnotched regions that subsequently form mesh crossings offset from one another in the respective adjacent grooves by approximately half a mesh node spacing, subjecting the strip to a flexing process in which webs adjoining bases of the notches and connecting the metal wires to each other undergo repeated bending deformation about their longitudinal axes such that incipient cracks are formed in the webs due to fatigue that results in a complete separation of the metal wires at the webs and no incipient cracks are formed at the mesh crossings, and thereafter spreading the strip with transverse tensile forces acting on its two most widely spaced metal wires such that a transverse stretching deformation of the strip is effected so as to create a mesh-like structure.

2. The method according to claim 1, wherein there is an even number of the metal wires.

3. The method according to claim 1, wherein a length of the mesh crossings as measured longitudinally of the grooves corresponds to approximately two times to four times a thickness of the strip material.

4. The method according to claim 1, wherein each notch is composed of a plurality of notch sections, the unnotched regions between the notch sections forming anchor lugs in the form of anchor projections after the metal wires have been spread.

5. The method according to claim 4, further comprising:

scoring unnotched regions between the notch sections for subsequent separation longitudinally of the grooves.

6. The method according to claim 1, further comprising:

providing both faces of the strip material with aligned grooves or notch sections forming mesh crossings and anchor lugs.

7. The method according to claim 1, wherein during the flexing process a number of bending motions and a bending angle are selected such that the webs and the anchor webs are separated from each other whereas the mesh crossings are not initially cracked.

8. The method according to claim 1, wherein the mesh crossings are each provided with a trough-like indentation that runs longitudinally of the grooves.

9. The method according to claim 1, further comprising:

passing the notched strip through a separation rolling unit in which a complete separation of the metal wires is reliably effected but not at the mesh crossings.

* * * * *